US010297181B2

(12) United States Patent
Fu

(10) Patent No.: US 10,297,181 B2
(45) Date of Patent: May 21, 2019

(54) SYSTEM OF SENSING AMOLED PIXEL DRIVING PROPERTY AND AMOLED DISPLAY DEVICE

(71) Applicant: Shenzhen China Star Optoelectronics Technology Co., Ltd., Shenzhen (CN)

(72) Inventor: Jianhang Fu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 144 days.

(21) Appl. No.: 15/106,833

(22) PCT Filed: May 13, 2016

(86) PCT No.: PCT/CN2016/081937

§ 371 (c)(1),
(2) Date: Jun. 21, 2016

(87) PCT Pub. No.: WO2017/161650

PCT Pub. Date: Sep. 28, 2017

(65) Prior Publication Data

US 2018/0082619 A1 Mar. 22, 2018

(30) Foreign Application Priority Data

Mar. 24, 2016 (CN) ..... 2016 1 0176342

(51) Int. Cl.

| | |
|---|---|
| ***G09G 3/00*** | (2006.01) |
| ***G09G 3/3258*** | (2016.01) |
| ***G09G 3/3233*** | (2016.01) |
| ***G09G 3/3291*** | (2016.01) |

(52) U.S. Cl.

CPC ..... *G09G 3/006* (2013.01); *G09G 3/3233* (2013.01); *G09G 3/3258* (2013.01); *G09G 3/3291* (2013.01); *G09G 2300/0819* (2013.01); *G09G 2300/0828* (2013.01); *G09G 2300/0842* (2013.01); *G09G 2310/027* (2013.01); *G09G 2320/0295* (2013.01);

(Continued)

(58) Field of Classification Search

CPC ..... G09G 3/3291; G09G 2300/0866; G09G 2320/02; G09G 2320/0295; G09G 2320/04; G09G 2320/043; G09G 2320/045; G09G 2330/025

See application file for complete search history.

(56) References Cited

FOREIGN PATENT DOCUMENTS

CN 104751793 A 7/2015

*Primary Examiner* — Stacy Khoo
(74) *Attorney, Agent, or Firm* — Leong C. Lei

(57) ABSTRACT

The present invention provides a system of sensing AMOLED pixel driving property and an AMOLED display device. In the sensing stage, the anode voltage of the organic light emitting diode and the output voltage of the variable negative voltage source (21) in the AMOLED pixel driving circuit (10) are coupled to the voltage addition circuit (22), and the voltage addition circuit (22) inputs the sum up result to the analog to digital converter (23), and because the variable negative voltage source (21) adjusts according to a change of the anode voltage of the organic light emitting diode, and the variable negative voltage source (21) and the voltage addition circuit (22) act together, and then an input voltage of the analog to digital converter (23) can be adjusted to make the input voltage always be in a sensing range of the analog to digital converter (23).

13 Claims, 4 Drawing Sheets

(52) U.S. Cl.
CPC . *G09G 2320/045* (2013.01); *G09G 2330/028* (2013.01); *G09G 2330/04* (2013.01); *G09G 2330/12* (2013.01)

SYSTEM OF SENSING AMOLED PIXEL DRIVING PROPERTY AND AMOLED DISPLAY DEVICE

FIELD OF THE INVENTION

The present invention relates to a display technology field, and more particularly to a system of sensing AMOLED pixel driving property and an AMOLED display device.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself.

As shown in FIG. 1, the driving circuits of the respective pixels in the present AMOLED pixel generally are a 2T1C structure, which is a structure comprising two thin film transistors and one capacitor. When such AMOLED pixel driving circuit works, the scan signal Scan controls the switch thin film transistor ST to be activated, and the data signal Data is transmitted to the gate of the drive thin film transistor T1 , and charges the capacitor C. The drive thin film transistor DT is activated, and the source of the drive thin film transistor DT is coupled to the anode of the organic light emitting diode OLED, and the current flows from the drive thin film transistor DT to the organic light emitting diode OLED to make the same emit light. Under the function of the capacitor C, the voltage level of the gate of the drive thin film transistor DT is not kept unit the image of the next frame is switched.

The AMOLED pixel driving property must be the same with one another in all positions of the display panel. However, in the practical situation, due to many reasons, such as the process difference, the usage environment change and aging, the respective MOLED pixel driving properties are not completely the same, which leads to the different brightnesses of the organic light emitting diode OLED as the same data signal is inputted to the AMOLED pixel and the influence to the display result. Therefore, it is required to sense the AMOLED pixel driving property and to compensate the data signal, correspondingly.

The external compensation technology of sensing the AMOLED pixel driving property and utilizing the external drive circuit of the display panel for compensation to promote the image quality and lifetime of the display panel has already appeared. The external compensation technology according to prior art utilizes the Analog to Digital Converter (ADC) to sense the AMOLED pixel driving property based on sensing the change of the anode voltage of the organic light emitting diode OLED and the change of the source voltage of the drive thin film transistor DT for compensating the inputted data signal. However, due to reasons of aging of the organic light emitting diode OLED or the drive environment change, the anode voltage of the organic light emitting diode OLED will be raised, and has possibility to exceed the input voltage range of the analog to digital converter. Accordingly, the anode voltage of the organic light emitting diode cannot be accurately sensed to influence the compensation result to the data signal.

SUMMARY OF THE INVENTION

An objective of the present invention is to provide a system of sensing AMOLED pixel driving property, which can make the voltage value inputted to the analog to digital converter be in the sensing range, and can accurately measure the anode voltage of the organic light emitting diode to ensure the accuracy of sensing the AMOLED pixel driving property, and thus to ensure the compensation result to the data signal for promoting the image quality of the AMOLED display device.

Another objective of the present invention is to provide an AMOLED display device, in which sensing the AMOLED pixel driving property is accurate, which can ensure the compensation result to the data signal and raise the image quality.

For realizing the aforesaid objectives, the present invention first provides a system of sensing AMOLED pixel driving property, comprising: an AMOLED display panel having AMOLED pixels aligned in array, and a working process of the AMOLED display panel is divided into a drive stage and a sensing stage, and each AMOLED pixel comprises a pixel driving circuit, and the pixel driving circuit is employed to receives a compensated data signal in the drive stage and to drive an organic light emitting diode therein to emit light;

a sensing module, which is electrically coupled to the pixel driving circuit in the sensing stage, is employed to sense an anode voltage of the organic light emitting diode;

a data compensation module, which is electrically coupled to the sensing module, and is employed to compensate an original data signal according to an sensing result outputted by the sensing module;

a digital to analog converter, which is electrically coupled to the data compensation module and the pixel driving circuit, is employed to perform digital to analog conversion to the compensated data signal outputted by the data compensation module and to transmit the same to the pixel driving circuit;

the sensing module comprises: a switch, a variable negative voltage source, a voltage addition circuit, an analog to digital converter and an offset compensation unit; one end of the switch is coupled to an anode of the organic light emitting diode in the pixel driving circuit, and the other end is coupled to a first input end of the voltage addition circuit; one end of the variable negative voltage source is grounded, and the other end is coupled to a second input end of the voltage addition circuit; an output end of the voltage addition circuit is coupled to one input end of the analog to digital converter; the other input end of the analog to digital converter receives a constant reference voltage, and an output end is coupled to an input end of the offset compensation unit; an output end of the offset compensation unit outputs the sensing result to the anode voltage of the organic light emitting diode to the data compensation module;

the variable negative voltage source adjusts a voltage value outputted to the voltage addition circuit according to a change of the anode voltage of the organic light emitting diode; the variable negative voltage source and the voltage addition circuit act together to adjust an input voltage of the analog to digital converter to make the input voltage always be in a sensing range of the analog to digital converter.

The offset compensation unit sums up an output result of the analog to digital converter and a digital quantity corresponded with an absolute value of the voltage value outputted by the variable negative voltage source to obtain the anode voltage of the organic light emitting diode.

The pixel driving circuit comprises: a switch thin film transistor, a drive thin film transistor, a capacitor and the organic light emitting diode; a gate of the switch thin film transistor receives a scan signal, and a source receives the compensated data signal, and a drain is electrically coupled to a gate of the drive thin film transistor; a source of the drive thin film transistor is electrically coupled to the anode of the organic light emitting diode, and a drain receives a positive power source voltage; two ends of the capacitor are electrically coupled to the gate and the source of the drive thin film transistor, respectively; the anode of the organic light emitting diode is grounded.

The switch is off in the drive stage to make the sensing module not work, and the pixel driving circuit receives the compensated data signal to drive the organic light emitting diode emit light;

the switch is on in the sensing stage to make the sensing module to sense the anode voltage of the organic light emitting diode.

The variable negative voltage source in the sensing module outputs various voltage values for various regions of the AMOLED display panel where the pixel driving circuits are.

The voltage outputted by the variable negative voltage source in the sensing module gradually decreases along with the increase of the usage time of the AMOLED display panel.

The sensing stage is set in a vertical blanking interval of the AMOLED display panel.

The present invention further provides an AMOLED display device, comprising the aforesaid system of sensing the AMOLED pixel driving property.

The present invention further provides a system of sensing AMOLED pixel driving property, comprising:

an AMOLED display panel having AMOLED pixels aligned in array, and a working process of the AMOLED display panel is divided into a drive stage and a sensing stage, and each AMOLED pixel comprises a pixel driving circuit, and the pixel driving circuit is employed to receives a compensated data signal in the drive stage and to drive an organic light emitting diode therein to emit light;

a sensing module, which is electrically coupled to the pixel driving circuit in the sensing stage, is employed to sense an anode voltage of the organic light emitting diode;

a data compensation module, which is electrically coupled to the sensing module, and is employed to compensate an original data signal according to an sensing result outputted by the sensing module;

a digital to analog converter, which is electrically coupled to the data compensation module and the pixel driving circuit, is employed to perform digital to analog conversion to the compensated data signal outputted by the data compensation module and to transmit the same to the pixel driving circuit;

the sensing module comprises: a switch, a variable negative voltage source, a voltage addition circuit, an analog to digital converter and an offset compensation unit; one end of the switch is coupled to an anode of the organic light emitting diode in the pixel driving circuit, and the other end is coupled to a first input end of the voltage addition circuit; one end of the variable negative voltage source is grounded, and the other end is coupled to a second input end of the voltage addition circuit; an output end of the voltage addition circuit is coupled to one input end of the analog to digital converter; the other input end of the analog to digital converter receives a constant reference voltage, and an output end is coupled to an input end of the offset compensation unit; an output end of the offset compensation unit outputs the sensing result to the anode voltage of the organic light emitting diode to the data compensation module;

the variable negative voltage source adjusts a voltage value outputted to the voltage addition circuit according to a change of the anode voltage of the organic light emitting diode; the variable negative voltage source and the voltage addition circuit act together to adjust an input voltage of the analog to digital converter to make the input voltage always be in a sensing range of the analog to digital converter;

wherein the offset compensation unit sums up an output result of the analog to digital converter and a digital quantity corresponded with an absolute value of the voltage value outputted by the variable negative voltage source to obtain the anode voltage of the organic light emitting diode;

wherein the pixel driving circuit comprises: a switch thin film transistor, a drive thin film transistor, a capacitor and the organic light emitting diode; a gate of the switch thin film transistor receives a scan signal, and a source receives the compensated data signal, and a drain is electrically coupled to a gate of the drive thin film transistor; a source of the drive thin film transistor is electrically coupled to the anode of the organic light emitting diode, and a drain receives a positive power source voltage; two ends of the capacitor are electrically coupled to the gate and the source of the drive thin film transistor, respectively; the anode of the organic light emitting diode is grounded.

The benefits of the present invention are: in the system of sensing the AMOLED pixel driving property and the AMOLED display device according to the present invention, in the sensing stage, the anode voltage of the organic light emitting diode and the output voltage of the variable negative voltage source in the AMOLED pixel driving circuit are coupled to the voltage addition circuit, and the voltage addition circuit inputs the sum up result to the analog to digital converter, and because the variable negative voltage source adjusts a voltage value outputted to the voltage addition circuit according to a change of the anode voltage of the organic light emitting diode, and the variable negative voltage source and the voltage addition circuit act together, and then an input voltage of the analog to digital converter can be adjusted to make the input voltage always be in a sensing range of the analog to digital converter. Then, the offset compensation unit is employed to sum up an output result of the analog to digital converter and a digital quantity corresponded with an absolute value of the voltage value outputted by the variable negative voltage source to obtain the anode voltage of the organic light emitting diode to realize the accurate measurement of the anode voltage of the organic light emitting diode to ensure the accuracy of sensing the AMOLED pixel driving property, and thus to ensure the compensation result to the data signal for promoting the image quality of the AMOLED display device.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
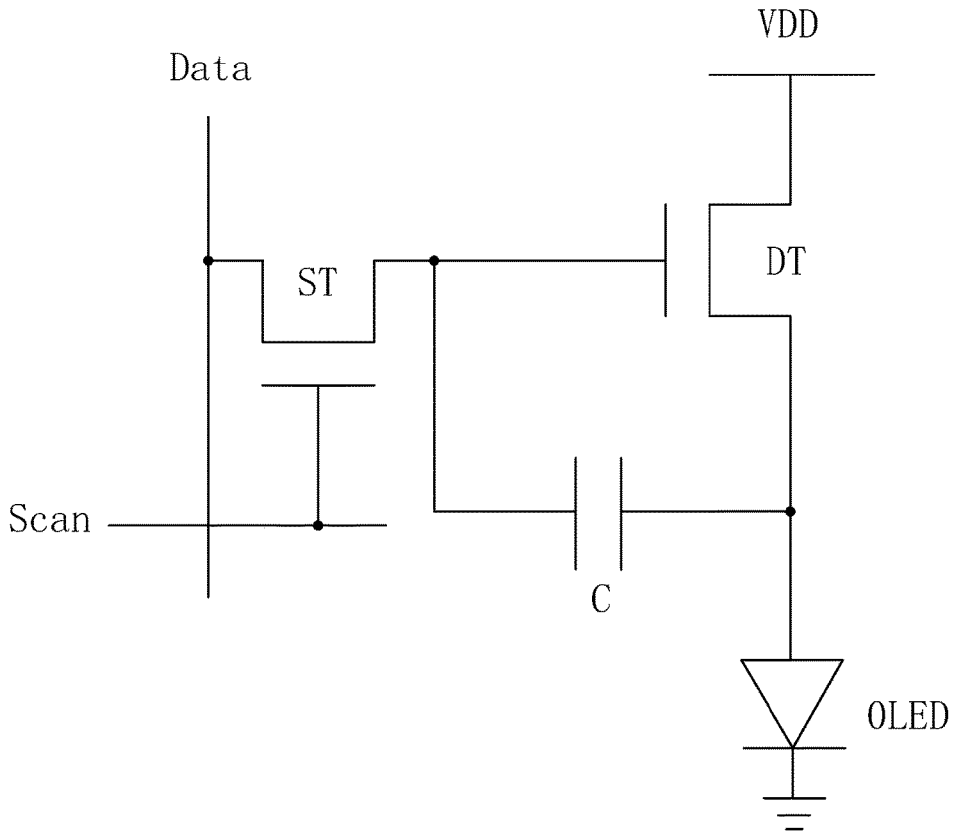
(Prior Art) Fig. 1
FIG. 1 is a circuit diagram of drive circuits of respective pixels in an AMOLED display device according to prior art.
Figure 2:
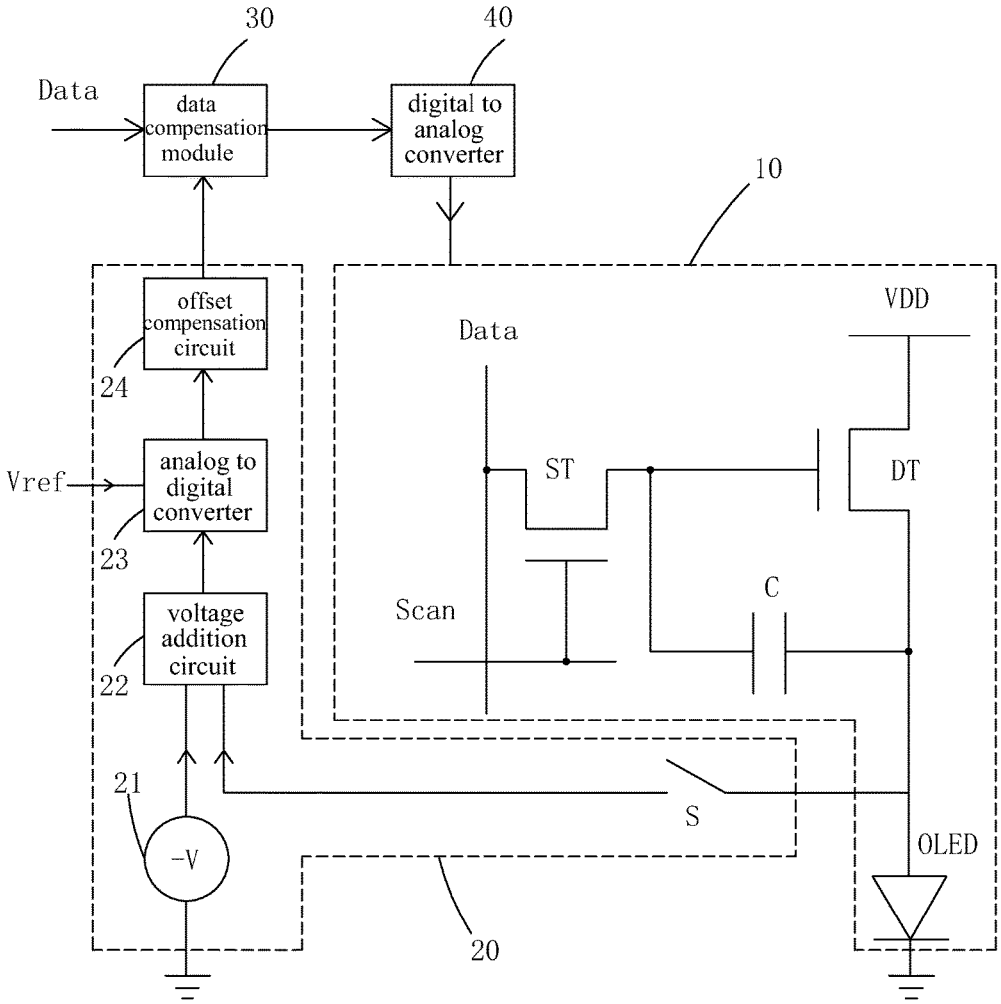
FIG. 2 is a structure block diagram of a system of sensing AMOLED pixel driving property according to the present invention.

Please refer to FIG. 2. The present invention first provides a system of sensing AMOLED pixel driving property, comprising:

an AMOLED display panel having AMOLED pixels aligned in array, a sensing module 20, a data compensation module 30 and a digital to analog converter 40.

A working process of the AMOLED display panel is divided into a drive stage and a sensing stage, and each AMOLED pixel comprises a pixel driving circuit 10. The pixel driving circuit 10 is employed to receives a compensated data signal Data in the drive stage and to drive an organic light emitting diode OLED therein to emit light. The pixel driving circuit 10 can select the 2T1C structure but not be limited thereto, and specifically comprises: a switch thin film transistor ST, a drive thin film transistor DT, a capacitor C and an organic light emitting diode OLED. A gate of the switch thin film transistor ST receives a scan signal Scan, and a source receives the compensated data signal Data, and a drain is electrically coupled to a gate of the drive thin film transistor DT; a source of the drive thin film transistor DT is electrically coupled to the anode of the organic light emitting diode OLED, and a drain receives a positive power source voltage VDD; two ends of the capacitor C are electrically coupled to the gate and the source of the drive thin film transistor DT, respectively; the anode of the organic light emitting diode OLED is grounded.

A sensing module 20, which is electrically coupled to the pixel driving circuit 10 in the sensing stage, is employed to sense an anode voltage of the organic light emitting diode, and to sense the AMOLED pixel driving property based on the anode voltage of the organic light emitting diode. Specifically, the sensing module 20 comprises: a switch S, a variable negative voltage source 21, a voltage addition circuit 22, an analog to digital converter 23 and an offset compensation unit 24. One end of the switch S is coupled to an anode of the organic light emitting diode OLED in the pixel driving circuit 10, and the other end is coupled to a first input end of the voltage addition circuit 22; one end of the variable negative voltage source 21 is grounded, and the other end is coupled to a second input end of the voltage addition circuit 22; an output end of the voltage addition circuit 22 is coupled to one input end of the analog to digital converter 23; the other input end of the analog to digital converter 23 receives a constant reference voltage Vref, and an output end is coupled to an input end of the offset compensation unit 24; an output end of the offset compensation unit 24 outputs the sensing result to the anode voltage of the organic light emitting diode OLED to the data compensation module 30.

The data compensation module 30 is electrically coupled to the output end of the offset compensation unit 24 in the sensing module 20, and meanwhile, receives the original data signal Data, and is employed to compensate the original data signal Data according to the sensing result outputted by the sensing module 20.

The digital to analog converter 40, which is electrically coupled to the data compensation module 30 and the pixel driving circuit 10, is employed to perform digital to analog conversion to the compensated data signal Data outputted by the data compensation module 30 and to transmit the same to the pixel driving circuit 10.

In the system of sensing AMOLED pixel driving property, the variable negative voltage source 21 adjusts a voltage value outputted to the voltage addition circuit 22 according to a change of the anode voltage of the organic light emitting diode OLED; the variable negative voltage source 21 and the voltage addition circuit 22 act together to adjust an input voltage of the analog to digital converter 23 to make the input voltage always be in a sensing range of the analog to digital converter 23.

Figure 3:
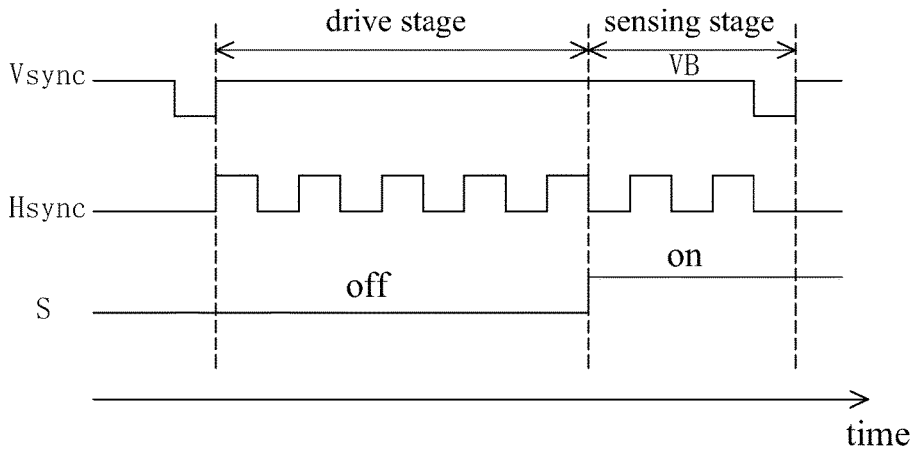
FIG. 3 is a display sequence waveform diagram of a system of sensing AMOLED pixel driving property shown in FIG. 2 based on Video Electronics Standards Association (VESA)

With combination of FIG. 3 and FIG. 2, the switch S is off in the drive stage to make the sensing module 20 not work, and the pixel driving circuit 10 receives the compensated data signal Data to drive the organic light emitting diode OLED emit light; the switch S is on in the sensing stage to make the sensing module 20 to sense the anode voltage of the organic light emitting diode OLED.

Specifically, the sensing stage is set in a vertical blanking interval VB of the AMOLED display panel. In the vertical blanking interval VB, the data enable signal is invalid, and thus, no image data is inputted in the sensing stage.

Figure 4:
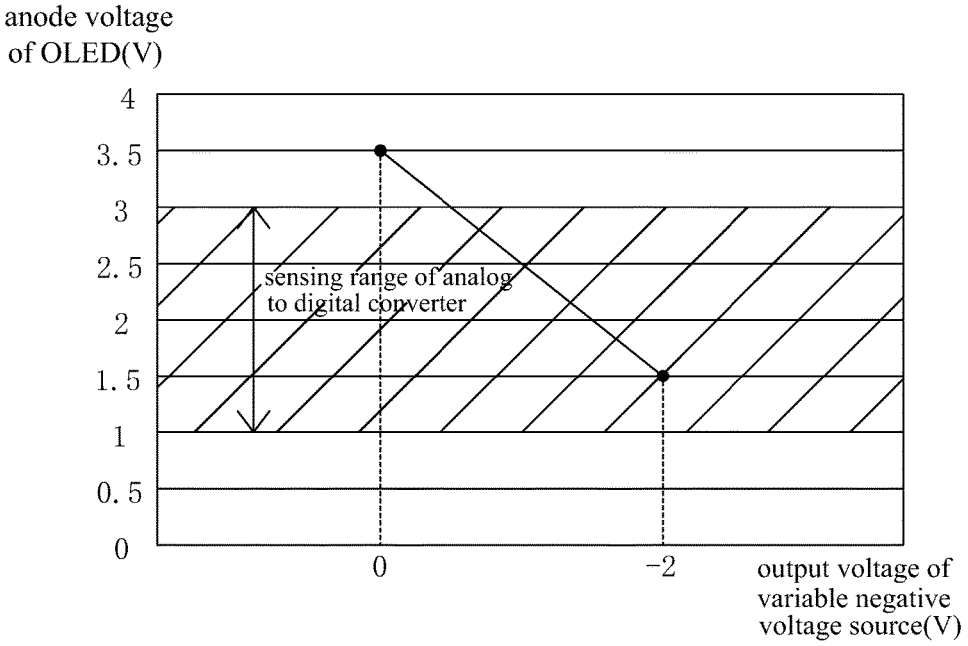
FIG. 4 is a diagram showing that the variable negative voltage source in the system of sensing the AMOLED pixel driving property gradually according to the present invention perform adjustment according to a change of the anode voltage of the organic light emitting diode to make the output result of the voltage addition circuit always be in a sensing range of the analog to digital converter.

Furthermore, in the sensing stage, the switch S is off, and then the anode voltage of the organic light emitting diode OLED enters the first input end of the voltage addition circuit 22 through the off switch S, and the second input end of the voltage addition circuit 22 receives the voltage value of the variable negative voltage source 21, and the voltage addition circuit 22 sums up the anode voltage of the organic light emitting diode OLED and the voltage value outputted by the variable negative voltage source 21, and transmits the result to one input end of the analog to digital converter 23. Then, by adjusting the output voltage value of the variable negative voltage source 21, it can be ensured that the sum up result of the voltage addition circuit 22 to the anode voltage of the organic light emitting diode OLED and the voltage value outputted by the variable negative voltage source 21, i.e. the output voltage of the analog to digital converter 23 always be in a sensing range of the analog to digital converter 23, and meanwhile, the analog to digital converter 23 receives the output voltage of the voltage addition circuit 22 and the constant reference voltage Vref at the same time, and outputs the result to offset compensation unit 24 after analog to digital conversion, and the offset compensation unit 24 sums up an output result of the analog to digital converter 23 and a digital quantity corresponded with an absolute value of the voltage value outputted by the variable negative voltage source 21 to obtain the anode voltage of the organic light emitting diode OLED. For instance, as shown in FIG. 4, the sensing range of the analog to digital converter 23 is set to be 2V, and the constant reference voltage is 1V, and then the analog to digital converter 23 can sense the voltage in the range of 1-3V. As the anode voltage of the organic light emitting diode OLED is raised up to 3.5V, which has already exceeded the sensing range of the analog to digital converter 23, and then if the variable negative voltage source 21 outputs the voltage of −2V, the voltage addition circuit 22 sums up the anode voltage 3.5V of the organic light emitting diode OLED and the voltage −2V outputted by the variable negative voltage source 21, and then the voltage of 1.5V in the sensing range of the analog to digital converter 23 is inputted to the analog to digital converter 23, and the analog to digital converter 23 outputs the result of 1.5V to offset compensation unit 24 after analog to digital conversion, and the offset compensation unit 24 sums up an output result of the analog to digital converter 23 and an absolute value of the voltage value outputted by the variable negative voltage source 21, i.e. a digital quantity corresponded with 2V to obtain the accurate anode voltage 3.5V of the organic light emitting diode OLED.

Significantly, the output voltage value of the variable negative voltage source 21 in the system of sensing the AMOLED pixel driving property according to the present invention can be adjusted on actual demands.

Figure 5:
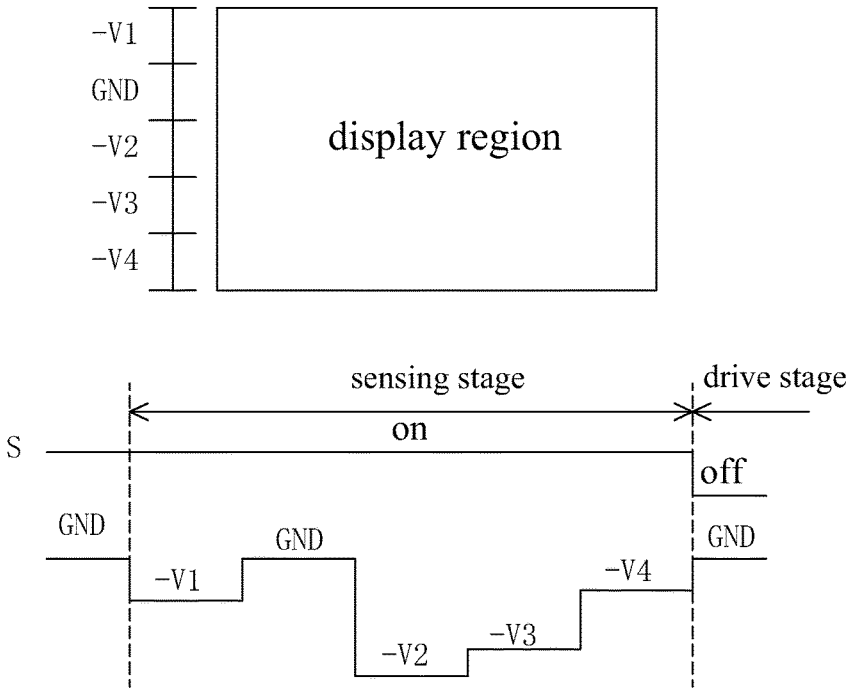
FIG. 5 is a diagram showing that the variable negative voltage source in the system of sensing the AMOLED pixel driving property according to the present invention outputs various voltage values for various regions of the AMOLED display panel.

Specifically, referring to FIG. 5, the variable negative voltage source 21 outputs various voltage values for various regions of the AMOLED display panel where the pixel driving circuits 10 are. Namely, as the raising value of the anode voltage of the organic light emitting diode OLED in some display region, where the pixel driving circuit 10 is, is higher, the variable negative voltage source 21 in this region outputs the lower negative voltage to ensure that the analog to digital converter 23 works in the sensing range; as the raising value of the anode voltage of the organic light emitting diode OLED in some display region, where the pixel driving circuit 10 is, is lower, the variable negative voltage source 21 in this region outputs the higher negative voltage to ensure that the analog to digital converter 23 works in the sensing range; if the anode voltage of the organic light emitting diode OLED in some display region, where the pixel driving circuit 10 is, does not exceed the sensing range of the analog to digital converter 23, the variable negative voltage source 21 outputs the GND voltage, i.e. the voltage value is 0.

Figure 6:
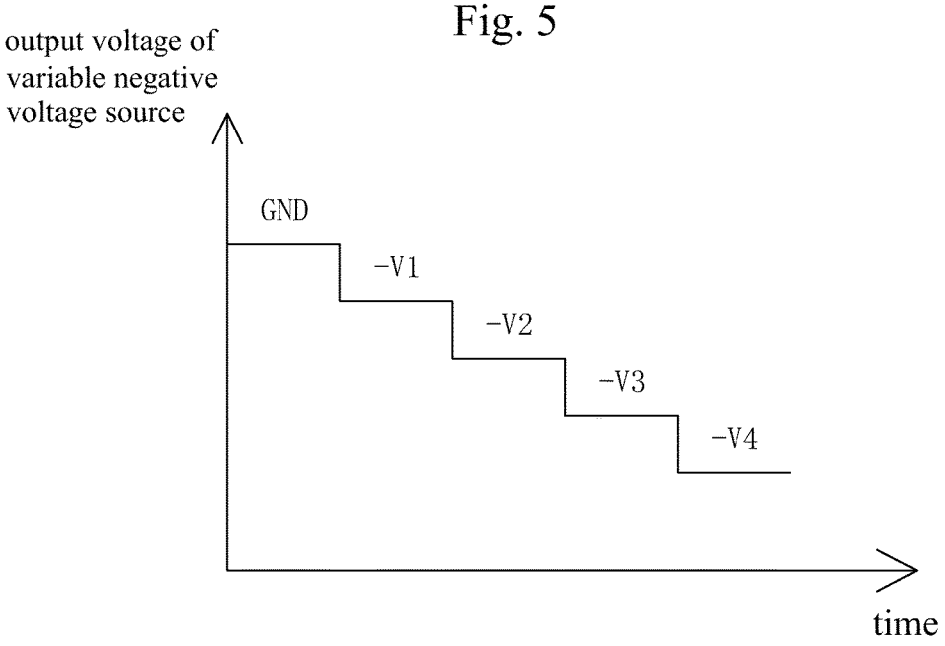
FIG. 6 is a diagram showing that the voltage outputted by the variable negative voltage source in the system of sensing the AMOLED pixel driving property according to the present invention gradually decreases along with the increase of the usage time of the AMOLED display panel.

Please refer to FIG. 6. The anode voltage of the organic light emitting diode generally is raised along with the increase of the usage time. Therefore, the voltage outputted by the variable negative voltage source 21 gradually decreases along with the increase of the usage time of the AMOLED display panel for ensuring the input voltage of the analog to digital converter 23 be in a sensing range.

On the basis of the same inventive idea, the present invention further provides an AMOLED display panel comprising the aforesaid system of sensing the AMOLED pixel driving property as shown in FIG. 2. Sensing the AMOLED pixel driving property is accurate, which can ensure the compensation result to the data signal and raise the image quality. No detail description of the system of sensing the AMOLED pixel driving property is repeated here.

In conclusion, in the system of sensing the AMOLED pixel driving property and the AMOLED display device according to the present invention, in the sensing stage, the anode voltage of the organic light emitting diode and the output voltage of the variable negative voltage source in the AMOLED pixel driving circuit are coupled to the voltage addition circuit, and the voltage addition circuit inputs the sum up result to the analog to digital converter, and because the variable negative voltage source adjusts a voltage value outputted to the voltage addition circuit according to a change of the anode voltage of the organic light emitting diode, and the variable negative voltage source and the voltage addition circuit act together, and then an input voltage of the analog to digital converter can be adjusted to make the input voltage always be in a sensing range of the analog to digital converter. Then, the offset compensation unit is employed to sum up an output result of the analog to digital converter and a digital quantity corresponded with an absolute value of the voltage value outputted by the variable negative voltage source to obtain the anode voltage of the organic light emitting diode to realize the accurate measurement of the anode voltage of the organic light emitting diode to ensure the accuracy of sensing the AMOLED pixel driving property, and thus to ensure the compensation result to the data signal for promoting the image quality of the AMOLED display device.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A system of sensing active matrix organic light emitting display pixel driving property, comprising:

an active matrix organic light emitting display panel having active matrix organic light emitting display pixels arranged in an array, wherein the active matrix organic light emitting display panel is selectively operable in a drive stage and a sensing stage, and each of the active matrix organic light emitting display pixels comprises a pixel driving circuit, which is adapted to receive a compensated data signal in the drive stage to drive an organic light emitting diode therein to emit light;

a switch comprising a first end and a second end, wherein the first end is coupled to an anode of the organic light emitting diode, wherein the switch is changeable between a closed condition and an open condition;

a voltage addition circuit comprising a first input end, a second input end, and an output end, wherein the first input end is connected to the second end of the switch to receive an anode voltage of the organic light emitting diode and the output end is connected to a first input end of an analog to digital converter; and a variable negative voltage source comprising a first end that is grounded and a second end that is coupled to the second input end of the voltage addition circuit to supply a voltage to the second input end of the voltage addition circuit;

wherein the analog to digital converter comprises a second input end that receives a constant reference voltage and an output end that supplies an output signal;

wherein the variable negative voltage source adjusts the voltage supplied through the second end thereof to the second input end of the voltage addition circuit according to a change of the anode voltage of the organic light emitting diode such that the variable negative voltage source and the voltage addition circuit act together to adjust a voltage supplied from the output end of the voltage addition circuit as an input voltage fed to the first input end of the analog to digital converter to make the input voltage within a sensing range of the analog to digital converter; and wherein the output signal supplied from the output end of the analog to digital converter is adapted to be processed and fed as the compensated data signal to the pixel driving circuit.

2. The system of sensing the active matrix organic light emitting display pixel driving property according to claim 1, wherein the output signal supplied through the output end of the analog to digital converter is processed by adding a digital quantity corresponding to an absolute value of the voltage supplied from the second end of the variable negative voltage source to obtain the anode voltage of the organic light emitting diode.

3. The system of sensing the active matrix organic light emitting display pixel driving property according to claim 1, wherein the pixel driving circuit comprises: a switch thin film transistor, a drive thin film transistor, a capacitor and the organic light emitting diode; the switch thin film transistor comprises a gate that receives a scan signal, a source that receives the compensated data signal, and a drain that is electrically coupled to a gate of the drive thin film transistor; the drive thin film transistor comprises a source that is electrically coupled to the anode of the organic light emitting diode and a drain that receives a positive power source voltage; the capacitor comprises two ends that are electrically coupled to the gate and the source of the drive thin film transistor, respectively; and the organic light emitting diode has a cathode that is grounded.

4. The system of sensing the active matrix organic light emitting display pixel driving property according to claim 1, wherein the switch is set in the open condition in the drive stage in which the pixel driving circuit receives the compensated data signal to drive the organic light emitting diode to emit light; and the switch is set in the closed condition in the sensing stage to feed the anode voltage of the organic light emitting diode to the first input end of the voltage addition circuit.

5. The system of sensing the active matrix organic light emitting display pixel driving property according to claim 4, wherein the variable negative voltage source outputs various voltage values for various regions of the active matrix organic light emitting display panel in which the pixel driving circuits are located.

6. The system of sensing the active matrix organic light emitting display pixel driving property according to claim 4, wherein the voltage supplied from the second end of the variable negative voltage source gradually decreases along with an increase of usage time of the active matrix organic light emitting display panel.

7. The system of sensing the active matrix organic light emitting display pixel driving property according to claim 4, wherein the sensing stage is set in a vertical blanking interval of the active matrix organic light emitting display panel.

8. An active matrix organic light emitting display device, comprising the system of sensing active matrix organic light emitting display pixel driving property according to claim 1.

9. A system of sensing active matrix organic light emitting display pixel driving property, comprising:

an active matrix organic light emitting display panel having active matrix organic light emitting display pixels arranged in an array, wherein the active matrix organic light emitting display panel is selectively operable in a drive stage and a sensing stage, and each of the active matrix organic light emitting display pixels comprises a pixel driving circuit, which is adapted to receive a compensated data signal in the drive stage to drive an organic light emitting diode therein to emit light;

a switch comprising a first end and a second end, wherein the first end is coupled to an anode of the organic light emitting diode, wherein the switch is changeable between a closed condition and an open condition;

a voltage addition circuit comprising a first input end, a second input end, and an output end, wherein the first input end is connected to the second end of the switch to receive an anode voltage of the organic light emitting diode and the output end is connected to a first input end of an analog to digital converter; and a variable negative voltage source comprising a first end that is grounded and a second end that is coupled to the second input end of the voltage addition circuit to supply a voltage to the second input end of the voltage addition circuit;

wherein the analog to digital converter comprises a second input end that receives a constant reference voltage and an output end that supplies an output signal;

wherein the variable negative voltage source adjusts the voltage supplied through the second end thereof to the second input end of the voltage addition circuit according to a change of the anode voltage of the organic light emitting diode such that the variable negative voltage source and the voltage addition circuit act together to adjust a voltage supplied from the output end of the voltage addition circuit as an input voltage fed to the first input end of the analog to digital converter to make the input voltage within a sensing range of the analog to digital converter;

wherein the output signal supplied from the output end of the analog to digital converter is adapted to be processed and fed as the compensated data signal to the pixel driving circuit;

wherein the output signal supplied through the output end of the analog to digital converter is processed by adding a digital quantity corresponding to an absolute value of the voltage supplied from the second end of the variable negative voltage source to obtain the anode voltage of the organic light emitting diode; and wherein the pixel driving circuit comprises: a switch thin film transistor, a drive thin film transistor, a capacitor and the organic light emitting diode; the switch thin film transistor comprises a gate that receives a scan signal, a source that receives the compensated data signal, and a drain that is electrically coupled to a gate of the drive thin film transistor; the drive thin film transistor comprises a source that is electrically coupled to the anode of the organic light emitting diode and a drain that receives a positive power source voltage; the capacitor comprises two ends that are electrically coupled to the gate and the source of the drive thin film transistor, respectively; and the organic light emitting diode has a cathode that is grounded.

10. The system of sensing the active matrix organic light emitting display pixel driving property according to claim 9, wherein the switch is set in the open condition in the drive stage in which the pixel driving circuit receives the compensated data signal to drive the organic light emitting diode to emit light; and the switch is set in the closed condition in the sensing stage to feed the anode voltage of the organic light emitting diode to the first input end of the voltage addition circuit.

11. The system of sensing the active matrix organic light emitting display pixel driving property according to claim 10, wherein the variable negative voltage source outputs various voltage values for various regions of the active matrix organic light emitting display panel in which the pixel driving circuits are located.

12. The system of sensing the active matrix organic light emitting display pixel driving property according to claim 10, wherein the voltage supplied from the second end of the variable negative voltage source gradually decreases along with an increase of usage time of the active matrix organic light emitting display panel.

13. The system of sensing the active matrix organic light emitting display pixel driving property according to claim 10, wherein the sensing stage is set in a vertical blanking interval of the active matrix organic light emitting display panel.

* * * * *